United States Patent [19]

Brodsky

[11] Patent Number: 4,910,503

[45] Date of Patent: Mar. 20, 1990

[54] MULTI-FUNCTION INPUT DEVICE AND SYSTEM

[76] Inventor: Stephen L. Brodsky, 4572 Vista Del Valle, Moorpark, Calif. 93021

[21] Appl. No.: 62,553

[22] Filed: Jun. 15, 1987

[51] Int. Cl.[4] ..... G09G 1/00

[52] U.S. Cl. ..... 340/706; 273/148 B; 341/35; 200/177; 200/179

[58] Field of Search ..... 340/709, 706, 711, 712, 340/365 R, 365 VL, 364; 273/148 B; 350/637; 200/177, 179, 176, 178

[56] References Cited

U.S. PATENT DOCUMENTS

| | | | |
|---|---|---|---|
| 3,918,021 | 11/1975 | Nishioka et al. | 273/148 B |
| 4,345,240 | 8/1982 | Amano et al. | 340/364 |
| 4,428,649 | 1/1984 | Main et al. | 350/637 |
| 4,516,939 | 5/1985 | Crimmins, Jr. | 340/365 R |
| 4,558,609 | 12/1985 | Kim | 273/148 B |
| 4,745,402 | 5/1988 | Auerbach | 340/712 |

FOREIGN PATENT DOCUMENTS

| | | | |
|---|---|---|---|
| 3117783 | 11/1982 | Fed. Rep. of Germany | 350/637 |

OTHER PUBLICATIONS

The Owner's Manual From a 1984 Plymouth Conquest–p. 25, published in 1984.

*Primary Examiner*—Gerald Brigance
*Attorney, Agent, or Firm*—Donald A. Streck

[57] ABSTRACT

An input device for providing X and Y coordinate analog input values and an associated function selection to a computer. There is a support plate and a multiposition function selection switch having an output indicating the position thereof. There is also selector apparatus carried by the support plate and operably connected for moving the function selection switch between its positions. There are coordinate generators for generating X and Y coordinate analog values at outputs thereof and activator apparatus carried in combination with the selector apparatus and operably connected to the coordinate generators for changing the X and Y analog values being output. The selector apparatus may comprise an annular member disposed parallel to the plane of the support plate with the activator apparatus disposed within the annular member. The function selection switch is a rotatable switch and the annular member is rotatable about a perpendicular axis to move the function selection switch between its positions. The preferred activator is a joystick member pivotal about a point adjacent the plane in which the annular member is disposed and also rotatable about a longitudinal axis thereof and operably connected to move the function selection switch between its positions when rotated. The preferred rotatable switch is a switch capable of indicating an infinite number of positions wherein a pair of switches actuated by a cam member provide direction and positional stepping information to associated logic.

3 Claims, 5 Drawing Sheets

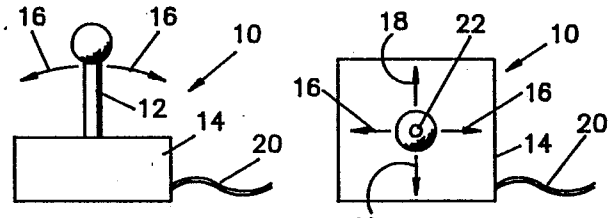
FIG. 1
FIG. 2
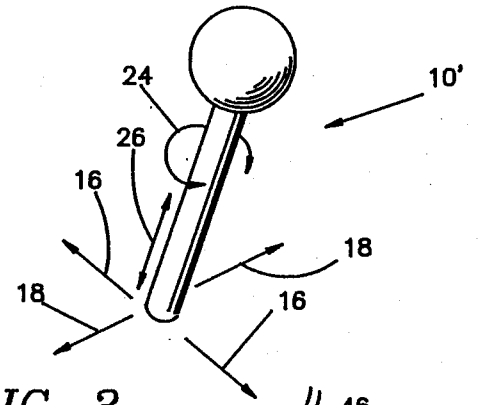
FIG. 3
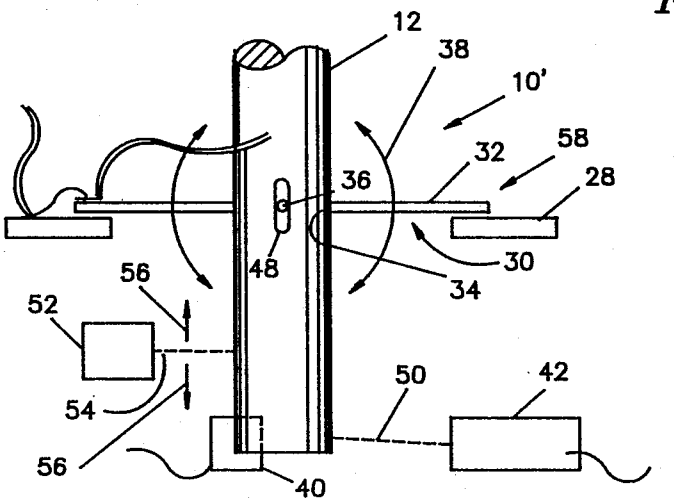
FIG. 4
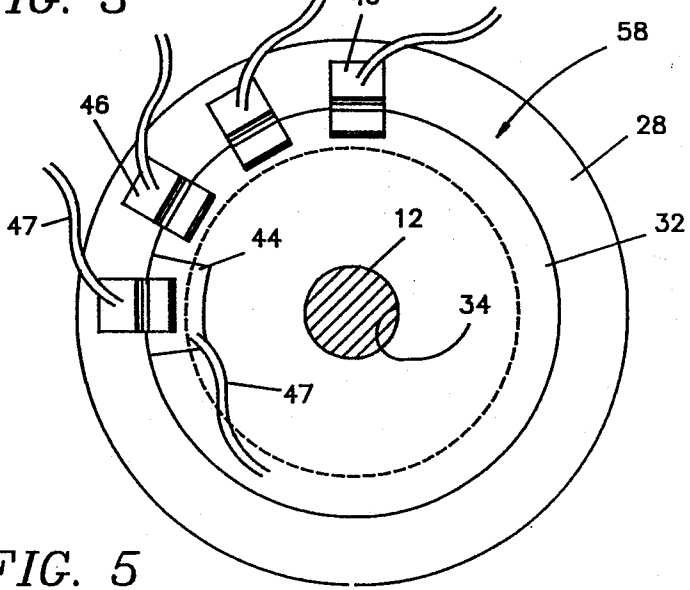
FIG. 5

MULTI-FUNCTION INPUT DEVICE AND SYSTEM

BACKGROUND OF THE INVENTION

The present invention relates to input devices for computers and, more particularly, to an input device for providing X and Y coordinate analog input values and associated function selection to a computer performing a plurality of user functions employing the input values comprising, a support plate; multi-position function selection switch means having an output indicating the position thereof; selector means carried by the support plate operably connected for moving the switch means between its positions; coordinate generator means for generating X and Y coordinate analog values at an output thereof; and, activator means carried in combination with the selector means and operably connected to the coordinate generator means for changing the coordinate generator means X and Y analog values being output.

To date, so-called "joystick" input devices as employed for providing dynamic X, Y coordinate analog inputs to computers have been rudimentary in their capabilities in the manner of FIGS. 1 and 2. Before going further, it should be noted that as employed herein the term "analog" is a term of convenience for want of a better term under the circumstances and includes bi-stable switches as typically employed in joystick type devices even though as bi-stable, they are also binary in essence. The difference being for purposes of this description that in an "analog" input device, the opened or closed statues of a switch or switches is sampled in the time domain to effect changes in the computer logic (or a bit stream as in the case of a track ball is sensed in the same time domain for the same purpose) rather than the binary value thereof being employed (i.e. binary 01011=decimal 11). Thus, it is applicant's intent that the term "analog" as employed in this description and the claims appended thereto not be limiting and that the scope and spirit of the invention accord an appropriate breadth thereto.

Joysticks such as that generally indicated as 10 in FIGS. 1 and 2 have most often been associated with real time inputs to computer systems having a video display associated therewith. Such systems have run the gamut from video games on the one extreme to sophisticated military command and control systems on the opposite extreme. Whether made of simple plastic parts or to mil-standard requirements, the functional aspects of the joystick input devices have remained substantially constant. As depicted in FIGS. 1 and 2, the typical prior art joystick input device 10 has a lever 12 which is spring-biased to a central position as shown from which it can be moved off center to create changes in X and Y signal generating apparatus contained within the housing 14. Whether potentiometers, switches, or the like, are the devices employed within the housing 14 is unimportant. Functionally, there is one apparatus associated with changes to the X coordinate value as indicated by the arrows 16 and another responding to movements of the lever 12 perpendicular to movements affecting the X coordinate which, in turn, affects changes in the y coordinate value as indicated by the arrows 18. In some cases, by moving the lever 12 at an angle to the coordinate axes (i.e., between the arrows 16, 18) changes to the X and Y values can be affected simultaneously. The device 10 is connected to the computer by a cable 20 which allows the status f the devices within the housing providing the X and Y values or changes thereto to be sampled by the computer. Occasionally, a button 22 is provided on the top of the lever 12 as shown in FIG. 2 (or on the housing 14) to be used as a "fire" button in video games or the like. The button 22 simply pushes a switch, the status of which is also sampled over the cable 20 by the computer. The button 22 and switch are simply conveniently mounted on the device 10 to be in close proximity for use in combination with the lever 12 when playing the game, or the like, and the combination of the lever 12 and button 22 provide no synergistic result as a result of the combination.

Typically in the prior art, whether using a joystick such as that shown in FIGS. 1 and 2 or other analog devices in combination with a computer, if more than one input is desired, a corresponding number of devices are employed, or, in the alternative, a single device is selected by the computer attached thereto as to which function is being accomplished thereby. Thus, there is no operator selectable multi-function input device and associated system available in the art at present.

Wherefore, it is the object of the present invention to provide a multi-function input device and associated system for use with computers wherein a single device can be operator-selectable for multiple functions to eliminate redundancy of components in the system.

SUMMARY

The foregoing object has been realized by the input device of the present invention for providing X and y coordinate analog input values, or the like, and associated function selection to a computer performing a plurality of user functions employing the input values comprising, a support plate; multi-position function selection switch means having an output indicating the position thereof; selector means carried by the support plate operably connected for moving the function selection switch means between its positions; coordinate generator means for generating analog values at an output thereof; and, activator means carried in combination with the selector means and operably connected to the coordinate generator means for changing the coordinate generator means' analog values being output.

In one embodiment, the selector means is an annular member disposed in a plane parallel to the plane of the support plate; and, the activator means is disposed within the annular member. Also, the function selection switch means is a rotatable switch and the annular member is rotatable about an axis perpendicular to the planes to move the function selection switch means between its positions.

In an alternate embodiment, the function selection switch means is a slidable switch and the annular member is slidable in its plane to move the function selection switch means between its positions.

Further in the aforesaid embodiment, the activator means is a joystick member pivotal about a point in the plane in which the annular member is disposed and the joystick member is also rotatable about a longitudinal axis thereof and is operably connected to the selector means for moving the function selection switch means between its positions when rotated.

In the preferred embodiment, the function selector switch means is an infinite position switch sensed by associated logic according to novel design of the applicant herein.

To obtain further benefits of the input device, indicator means may be operably connected to the function selector switch means for visually displaying its present position. In one embodiment, the indicator means comprises display panel means for visually displaying an indication of the function associated with the present position of the function selector switch means and logic means operably connected to the display panel means and the output of the function selector switch means for causing the display panel means to display the function associated with the present position of the function selector switch means.

DESCRIPTION OF THE DRAWINGS

FIG. 1 is a simplified side view of a prior art joystick input device.

FIG. 2 is a top view of the device of FIG. 1.

FIG. 3 is a perspective drawing of the lever portion of a joystick according to the present invention showing the various movements to which it may respond for providing changes in analog input values in combination with function selection.

FIG. 4 is a drawing showing how the lever of FIG. 3 may be mounted and pivoted in a non-preferred manner to effect changes in both the analog input value devices and a function selector switch.

FIG. 5 is a top view of the selector switch portion of FIG. 4.

DESCRIPTION OF THE PREFERRED EMBODIMENT

Figure 6:
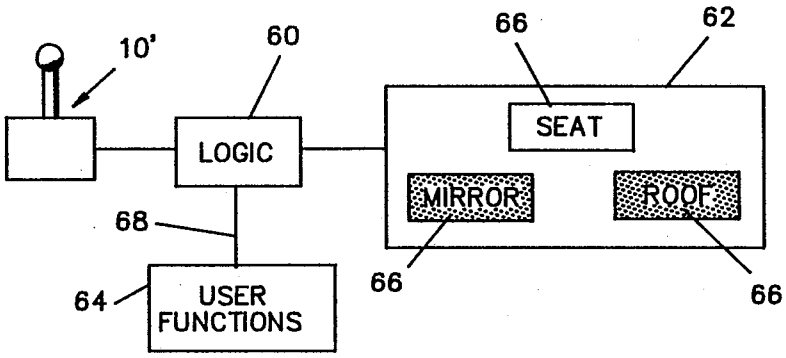
FIG. 6 is a block diagram of a multi-function input system according to the present invention.

Broadly stated, the present invention comprises a multi-function input device snnergistically combining X, Y coordinate analog input changeability with function selectability. As used herein, the term "X, Y coordinate" is used as a term of convenience only and simply means analog inputs resulting from the movement of an input device which is capable of movement in two perpendicular directions singly or in combination. The invention also comprises a system for employing the device with a computer, or the like. As employed herein, the term "computer" envisions use with any computer; but, principally micro-processors such as those presently employed with automobiles, wheel chairs, graphics plotters, medical devices and numerous other devices as wherein the benefits of the present invention can best be realized to their full advantage. The invention also incorporates and comprises an infinite position switch of novel design. The primary discussion hereinafter is with respect to a joystick type input device. As those skilled in the art will appreciate, the novel aspects of the present invention also can be incorporated into other input devices known in the art. Several examples of such alternate devices as presently contemplated by the applicant will be discussed briefly later in this description.

As shown in FIG. 3, when incorporated as part of a joystick input device 10', the X, Y coordinate value changes (or the like) are affected in the manner of the prior art of FIGS. 1 and 2, i.e., by pivoting the lever 12 about a pivot point in the direction of arrows 16 and 18 individually or in combination. Function changes can be indicated in one or both of two ways depending upon the construction desired and the number of functions to be selectable. For example, as indicated by the arrow 24, the lever 12 can be rotated about its longitudinal axis. In the alternative, the lever 12 can be pulled up or pushed down as indicated by the arrow 26.

One non-preferred manner of mechanically accomplishing the above-described multi-functions with a single device can best be understood with reference to FIGS. 4 and 5. As shown therein, the joystick input device 10' of the present invention incorporates a support plate 28 having an opening 30 therein through which the lever 12 is disposed. A circular plate 32 is mounted for rotation over the opening 32 and has the lever 12 passing through a bore 34 concentrically disposed on the axis of rotation thereof. The lever 12 is attached to the plate 32 adjacent the bore 34 in any of a number of manners well known to those skilled in the art so as to provide a pivot point 36 generally in the plane of the plate 32 and support plate 28 about which the lever 12 can pivot as represented by the arrows 38. The bottom of the lever 12 is operably attached to move the X and Y input devices 40, 42, respectively, in the usual manner. The circular plate 32 has a single electrical contact 44 thereon as bes seen in the top view of FIG. 5. As also best seen from that figure, the support plate 28 has a plurality of spaced contacts 46 thereon which can be placed individually in electrical contact with the contact 44 by rotating the lever 12 and plate 32 in combination. As will be appreciated, since the pivot point 36 is substantially in the plane of the plate 32 and support plate 28, the lever 12 can be rotated to turn the plate 32 to position the contact 44 at any of the contacts 46 without affecting the pivotability of the lever 12 for its other functions. Wires 47 are attached to the contacts 44, 46 so that the selected position (to be associated with a function or the like) can be electrically sensed.

In vertical sensing as depicted by the arrow 26 in FIG. 3 (either in addition to the above-described rotary selection or as a replacement therefore), the eever 12 has a longitudinal slot 48 therein by means of which the pivot point 36 is operably connected to the lever 12 so as to allow longitudinal movement of the eever 12 as well. The slot 48 can be relatively short such that the connection or linkage to the devices 40, 42, indicated by the dotted line 50, are virtually unaffected. It should be noted that the pivoting and longitudinal movements of the lever as desired could be accomplished by connecting the lever 12 to the plate 32 with a diaphragm of an elastomeric material or with a spring metal universal joint. In such case, the slot 48 would not be required as its function would be incorporated into the connecting device. A switch 52 is operably connected to the lever 12 as indicated by the dotted line 54 so as to respond to the longitudinal up and down movements of the lever 12 in the direction of the arrows 56. Thus, it can be seen that with the present invention, function selectability can extend from a simple two-function selection as by switch 52 alone being bi-stable so as to indicate a first function when the lever 12 is pulled up and a second function when the lever 12 is passed down to a multi-function selection system combining the switch 22 in combination with the switch 58 (i.e., plate 32, contact 44, and contacts 46). As those skilled in the art will appreciate, by combining switches 52 and 58 in the function selection operation, switch 58 can be employed to indicate a first plurality of functions with switch 52 in a first position and an entirely different set of functions with switch 52 in a second position.

Having thus described a totally mechanical joystick input device 10' according to the present invention in a non-preferred embodiment, the manner of incorporating that device into different systems for optimum benefit therefrom in differing environments will now be described prior to a detailed description of the preferred joystick type input device of the present invention incorporating applicant's infinite position switch.

Figure 7:
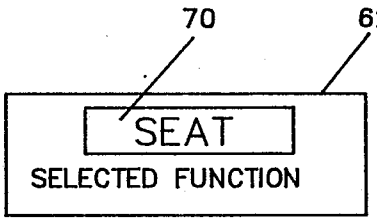
FIG. 7 is a drawing showing an alternate embodiment of the display portion of the system of FIG. 6.
Figure 8:
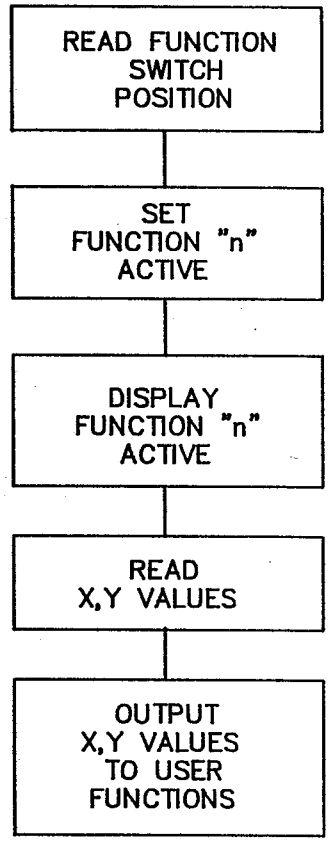
FIG. 8 is a logic diagram of the logic performed by the system of FIG. 6.

The first system embodiment of the present invention as shown in FIGS. 6–8 corresponds to a system as employed in the automotive field by applicant herein. In use, the input deice 10' is connected to logic 60 which acts as an interface between a function display 62 and the user functions 64 employing the inputs provided by the device 10'. Those skilled in the art will recognize that the separate blocks in the figures for logic 60 and user functions 64 will, in actual implementation, be combined into one set of firmware performing both functions. In a tested embodiment of the applicant, the display 62 comprised a plurality of individually lightable panels 66 having indicia thereon indicating the function which had been selected. Thus, as depicted in the display 62 as drawn in FIG. 6, the functional selection within the device 10' (i.e., switch 52 or switch 58) has selected the "SEAT" function. Thus the "SEAT" panel 66 is illuminated and, correspondingly, the logic 60 informs the user function 62 of that selection over line 68 connected thereto. As an alternative to the display 62 a as shown in FIG. 6, a display 62' such as that shown in FIG. 7 could be substituted for the display 62. In that display, a single alpha-numeric panel 70 such as an LCD panel, or the like, is employed. In such case, the logic 60 would additionally be required to display a pre-selected name for the function on the panel 70 rather than merely illuminate an associated panel 66 as in the previous embodiment. The use of such alpha-numeric displays is well known to those skilled in the art and, therefore, no further description is incorporated herein in the interest of brevity and the avoidance of redundancy.

The logic 60 of FIG. 6 incorporates the logic sequence shown in FIG. 8. Thus, in performing its functions, logic 60 first reads the function switch position on deice 10'. As previously mentioned, logic 60 next informs the user function 62 over line 68 that function "n" is now active; that is, the input device 10' is providing X, Y coordinate information, or the like, to be applied to function "n". Logic 60 simultaneously displays on the display 62 that it is function "n" which is now active with respect to the input device 10'. The X, Y values (i.e., the inputs from devices 40, 42) are then read by logic 60 and output to the user functions 62 over line 68.

The above-described system of FIGS. 6-8 as employed by the applicant in automotive uses has its functional feedback to the operator in the form of physically determinable movement. Thus, when using the device 10' to adjust the seat of an automobile in which he is sitting, the operator can feel the associated movement of the seat. Simiarly, if the device is used to manipulate an outside mirror, the mirror can be viewed and adjusted accordingly. A sunroof being opened and closed can be seen as to the direction of movement and the amount of movement which has been accomplished. In other applications possible with the present invention, such visual confirmation may or may not be available. In such instances, the system embodiment of the present invention as depicted in FIGS. 9 and 10 can be employed.

Figure 10:
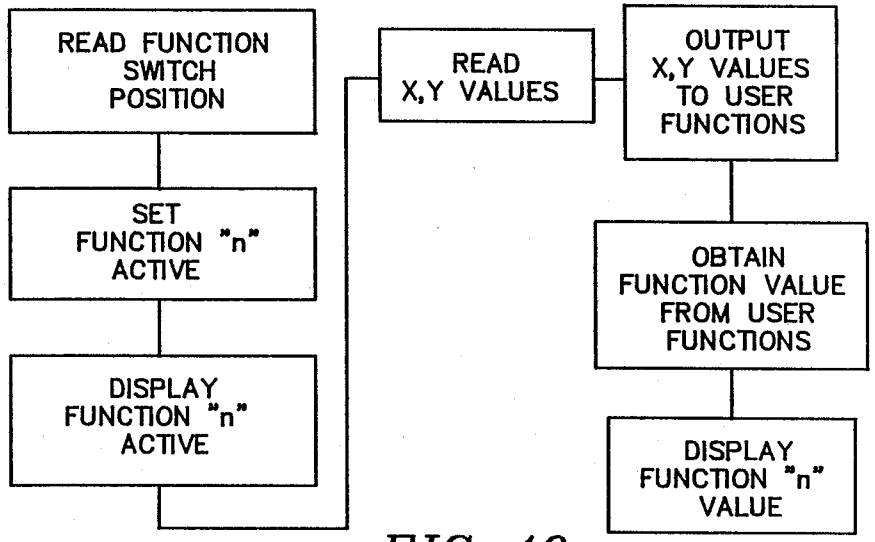
FIG. 10 is a logic diagram of the logic performed by the system of FIG. 9.
Figure 9:
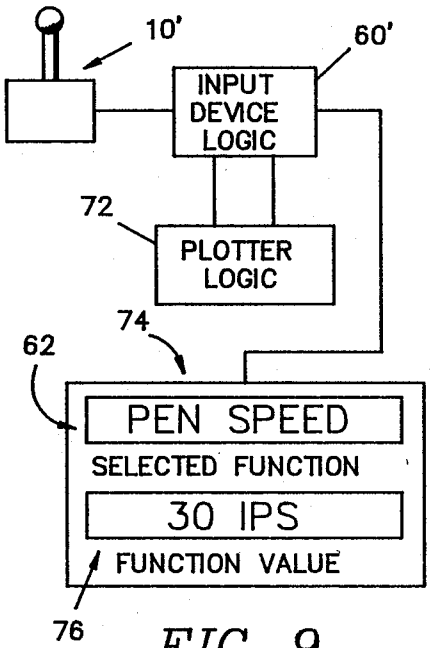
FIG. 9 is a block diagram of a multi-function input system according to the present invention in an alternate embodiment thereof.

FIGS. 9 and 10 are a specific example of how the present invention could be employed with a graphics plotter to perform many input selections and changes therein with a single input device. In this embodiment, the input device logic 60' is bi-directionall connected to the plotter logic 72. That is, the logic 60' not only sends information to the plotter logic 72 as it did with the user functions 62 of the previous embodiment; but, additionally, receives appropriate information back from the plotter logic 72 to be employed in its display functions. Again, in actual commercial implementation, the logic 60' and plotter logic 72 would be combined and any information transfer would be nnternal to the single logic entity. In this embodiment, an overall disllay panel 74 combines the function display 62 of the previous embodiment with a function value display 76 by which the present value ring input by the device 10' can be visually displayed to the operator. In this embodiment, it is preferred that an alpha-numeric display panel such as depicted previously in FIG. 7 be employed for both display 62 and 76. As shown by way of example in FIG. 9, the input device 10' can be used to select the function of PEN SPEED which is displayed on the panel 74 in the function display 62 portion thereof. As the devices 40, 42 are employed singly or in combination to effect changes in the pen speed of the plotter controlled by logic 72, the logic 72 inputs a corresponding function value to the logic 62' which is used by the logic 62' to display a meaningful value on the function value display 76 of panel 74. For example, the lever 12 could be pushed forward to cause the potential value of pen speed to increase and be pulled backwards to cause it to decrease. When the desired speed is displayed, the lever could be moved to the right to indicate to the plotter logic 72 that the presently displayed value should be used.

The logic for this latter embodiment is broadly set forth in the logic diagram of FIG. 10. As with the previous embodiment, the logic 60' reads the function switch position, sets function "n" as active (within the combined logic 60', 72), displays function "n" as active, reads the X, Y values, and outputs the X, Y values to the user functions (i.e. the plotter logic 72 portion of the firmware). Adiitionally, however, the logic 60' goes on to obtain the function value from the user functions and display the function "n" value on the display as well.

Having thus described the system aspects of the present invention, the preferred embodiment for a joystick type input device according to the present invention and employing the logic portions of the above-described systems will now be described in detail with respect to FIGS. 14–16. The preferred joystick input device 10" compises a support plate 28' rotatable supporting a lower shaft 90 in a bearing 92. A planar cam member 94 having a peripheral camming surface 96 is mounted perpendicularly to the lower shaft 90 and parallel to the support plate 28' for rotation in combination with the lower shaft 90. The configuration of the peripheral camming surface 96 can best be seen with reference to FIG. 15. The cam member 94 will be returned to shortly.

A stiff coil spring 98 is concenrically attached to the top of the lower shaft 90 to rotate in combination therewith and an upper shaft 100 is concentrically attached to the top of the spring 98. Both attachments to the spring 98 can be accomplished by silver soldering, or the like. A planar circular pressure member 102 is mounted perpendicularly to the upper shaft 100 and parallel to the support plate 28' for rotation in combination with the lower shaft 90. By pivoting the upper saft 100 about the spring 98 as a pivot point, the pressure member 102 can be tipped down in the direction that the upper shaft 100 is pivoted. Because the spring 98 is stiff, it acts as a bias force to restore the upper shaft to its coaxial alignment with the lower shaft 90 when pivoting pressure against it is released.

Four microswitches 104 are mounted at 90° spacings about the underside of the pressure member 102 with their activating arms 106 positioned to be depressed (thus closing the switch) when the pressure member 102 is tipped against a respective arm 106. The outputs of the microswitches 104 are individually electrically connected to the logic 60 to be sensed thereby as the analog X,Y signals; that is, one opposed pair of the microswitches 104 indicate "−" and "+" changes, respectively, being affected to the X value while the 90° oriented other opposed pair of the microswitches 104 indicate "−" and "+" changes, respectively, being affected to the Y value. The operation of such switches as a biaxial joystick to create the output signal therefrom is known in the art and, per se, forms no point of novelty of the present invention.

Figure 15:
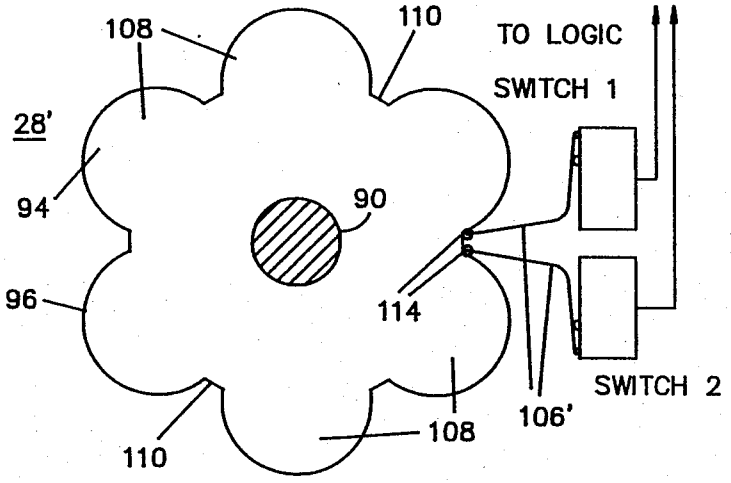
FIG. 15 is a plan view of the cam and switch arrangement of the present invention employed to create applicant's infinite position rotatable switch.
Figure 16:
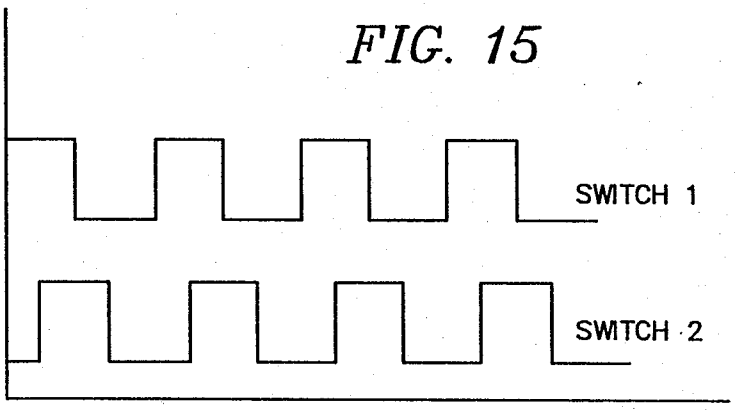
FIG. 16 is a graph showing a typical waveform from the two switches of the apparatus of FIG. 15 which is decoded by the logic of the present invention to determine the position of the infinite position switch.

Returning now to the cam member 94 and its function within the present invention, as can best be seen in FIG. 15, the peripheral camming surface 96 comprises a plurality of lobes 108 separated by a plurality of lands 110. A pair of microswitches 112 are mounted to the support plate 28' adjacent one another with their spring metal, roller tipped actuating arms 106' in contact with the caming surface 96 in close proximity. More specifically, the roller iips 114 of the arms 106' are close enough together and the lands 110 are wide enough that the roller tips 114 can both be on one land 110 simultaneously with one tip 114 adjacent the junction of the land 110 and the lobe 108 on one side thereof and wit the other tip 114 adjacent the junction of the land 110 and the lobe 108 on the other side. The effect of this arrangement is two-fold. First, the roller tips 114, under the biasing force of the spring metal actuating arms 106', act as a rotary detent with respect to rotation of the shafts 90, 100 in combination. Thus, the "switching" action of rotating the upper shaft 100 from "position" to "position" can be felt by the operator by the snapping of the roller tips 114 from one detent position on one land 110 over the adjacent lobe 108 to the next adjacent land 110. Second, one tip 114 will ride up on a lobe 108 and closes its microswitch 112 before the other tip 114 rides up the same lobe 108 and closes its microswitch 112. The outputs from the microswitches 112 are also connected as inputs to the logic 60 and appear as shown in FIG. 16 by way of example. A the upper shaft 100 is rotated by the operator, the cam member 94 is rotated causing the microswitches 112 to output a series of square waves as the microswitches 112 are opened and closed. Since the tips 114 do not ride up a lobe 108 simultanoously, the square waves are out of phase as depicted in FIG. 16. By determining which micooswitch 112 closed first, the logic 60 can tell which direction the upper shaft 100 is being rotated. For example, as shown in FIG. 16, the SWITCH 1 square waves are leading the SWITCH 2 square waves. Thus, the cam member 94 must be rotating clockwise as the figure is viewed. The logic 60 simply counts one switch "position" for each square wave pulse or movement from detent position to the next. Thus, the switch comprised of microswitches 112 as interpreted by the logic 60 is infinite in the number of positions it can have wherein each "position" is defined by the logic 60 in terms of the number of positions from a known starting point As a practical matter, therefore, the number of positions will be determined by the size of the logic 60 and its attendant capacity to define the positions.

While joystick type input devices have been described with great particularity hereinbefore, it will be recalled that applicant contemplates employing the present invention with other known analog input devices as well. Several such incorporations as intended to be included with in the scope and spirit of the present invention will now be described broadly. Two more detailed descriptions of alternate embodiments employing applicant's above-described infinite position switch will then be described. As those skilled in the art will appreciate, these further examples are not exhaustive and, therefore, their inclusion is not to be considered as limiting of the present invention or the claims appended hereto.

Figure 11:
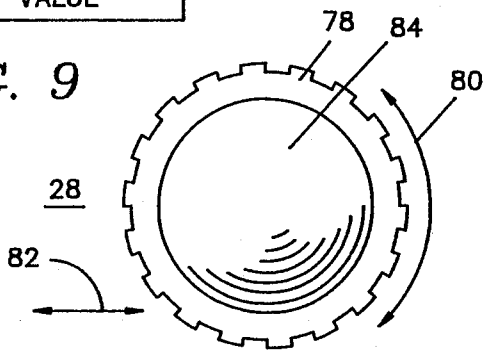
FIGS. 11–13 are alternate embodiments for the input device of the present invention.
Figure 12:
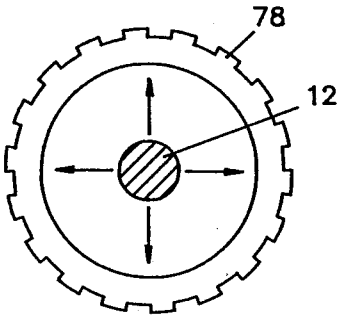
Figure 13:
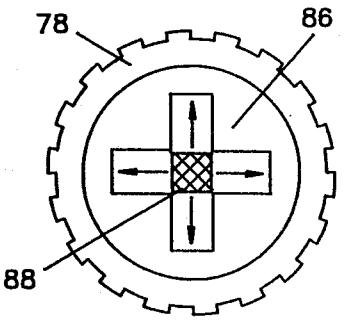

As generally applicable to the embodiments of FIGS. 11–13, the X, Y input device can be mounted within a bezel 78 attached to the support plate 28 of FIG. 4 for either rotary motion as indicated by the arrow 80 and/or sliding motion as indicated by the arrow 82. In this manner, the bezel 78 can be operably attached to rotate, for example, the previously-described circular plate 32 or operably connected to slidably operate switch 52 through horizontal motion instead of vertical motion as employed in the previously-described embodiment. The bezel could also be connected to rotate the cam member 94 of the preferred embodiment as described above and, thereby, incorporate the infinite position switch of the present invention with these alternate embodiments. What is to be appreciated is that the bezel 78 moves by rotation and/or sliding in a plane close adjacent and parallel to the plane of the support plate 28 and the X, Y input device is carried within the bezel 78 for motion about a point in virtually the same plane in the same manner that, as described previously, the lever 12 was mounted for pivotal motion about a point close adjacent the plates 28 and 32 or upper lever 100 was mounted for pivotal motion about a point in the spring 98 close adjacent the support plate 28'.

In the specific embodiment of FIG. 11, the X, Y input device is a so-called "track ball" 84 to which the analog signal producing devices 40, 42 are attached by a rolling connection in a manner well known to those skilled in the art. Note that as with the other analog devices of the present invention the movement of the track ball 84 is a rolling motion about a rotation point contained generally in the plane of the bezel 78. FIG. 12 depicts an embodiment wherein a pivoting lever 12 (i.e., a joystick) is mounted within the bezel 78 in a manner similar to the embodiment of FIG. 4. It should be noted that the "lever" 12 could conveniently be a small, short, finger-tippable lever instead of a long joystick to be grabbed with the hand. In this case, however, instead of rotating the lever 12 to effect function changes, the bezel 78 surrounding the lever 12 and supporting it, rotates or slides to effect function changing. Finally, as depicted in FIG. 13, a bidirectional slide mechanism 86 could be mounted within the bezel 78 and connected to the devices 40, 42 to operate the devices 40, 42 by sliding motion of a button 88. Note again that the button 88 slides an has its motion generally in the plane of the bezel 78. As will be appreciated, the use of the slide mechanism 86 can be accomplished with simple switches to be functionally equivalent to the joystick mechanisms previously described but with a lower profile as well as simpler and less costly construction. With such a device, single axis movement only would be accomplished; however, in certain applications this might be preferable as having two effects simultaneously might be confusing to the operator. The plotter application described above where speed indication and select on were being accomplished as separate functions would be a good example of such an application.

Figure 14:
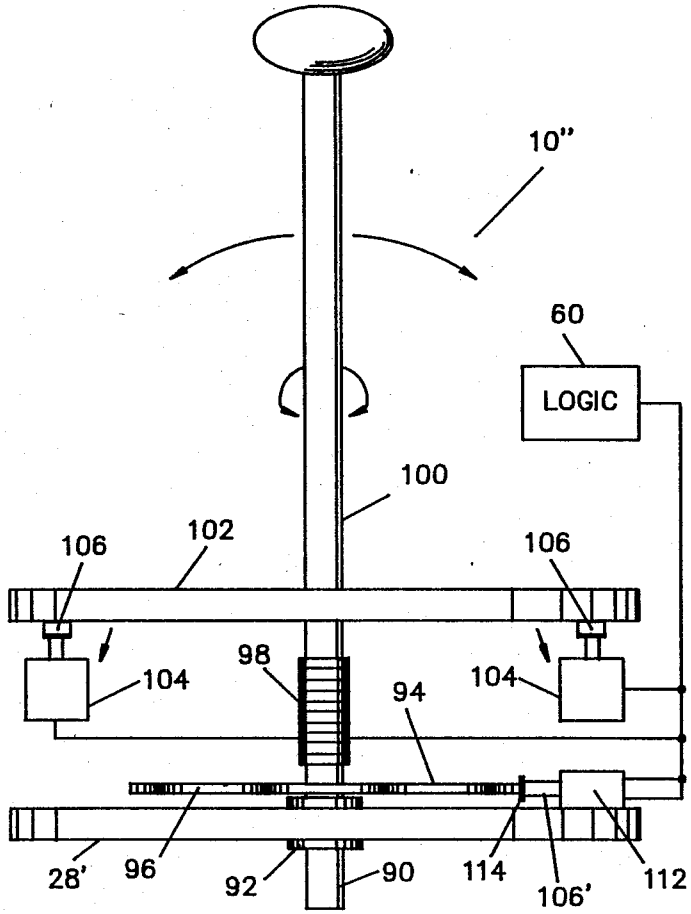
FIG. 14 is a side view of a joystick type input device according to the present invention in its preferred embodiment incorporating applicant's infinite position rotatable switch therein.
Figure 17:
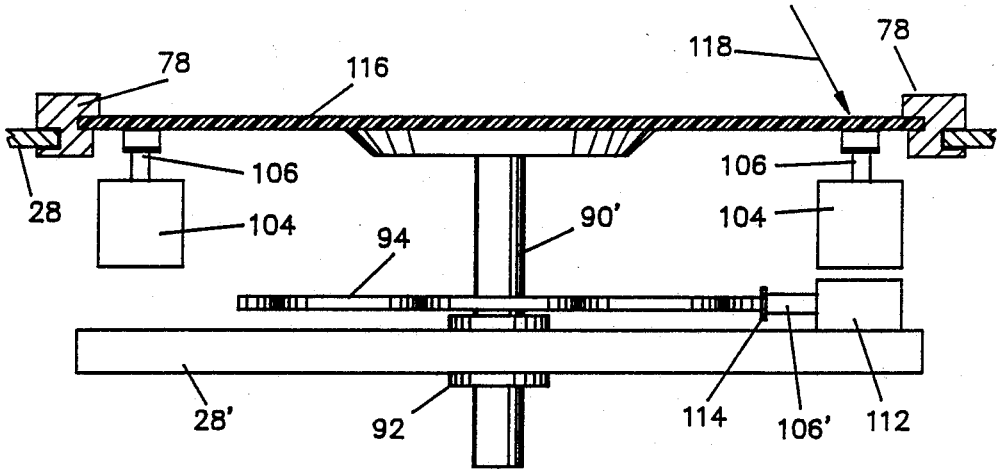
FIG. 17 is a side view of a non-joystick type input device according to the present invention employing a rotating bezel and incorporating applicant's infinite position rotatable switch therein.
Figure 18:
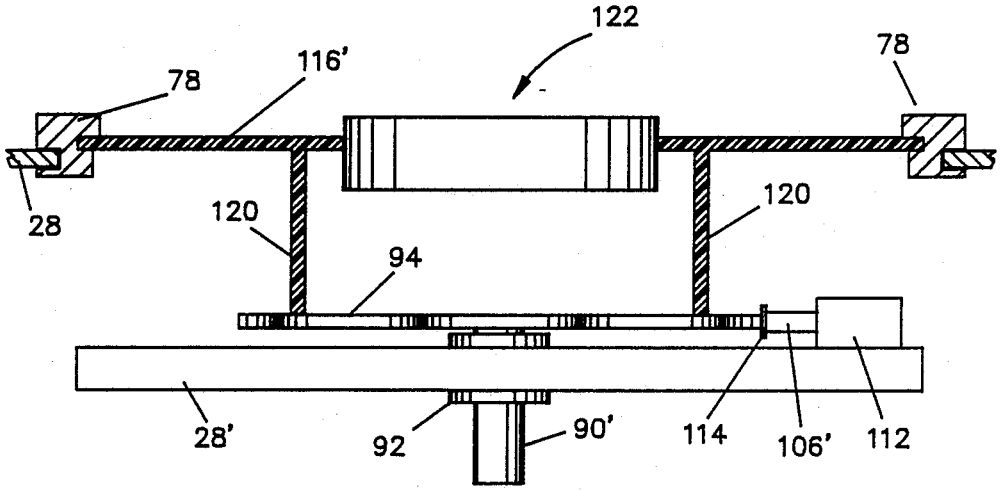
FIG. 18 is a side view of another non-joystick type input device according to the present invention employing a rotating bezel to rotate applicant's infinite position rotatable switch therein.

Turning now to FIGS. 17 and 18 the present invention is shown in two embodiments wherein a non-joystick is employed as the X,Y input device carried within a rotating bezel 78 as generally described above and the bezel is rotated to turn the cam member 94 of applicant's infinite position switch as previously described in detail with respect o FIG. 14. In this regard, components which have remained the same in these embodiments are labelled with like numbers for ease of reference.

In the embodiment of FIG. 17, the bezel 78 contains a flexible plastic membrane 116 therein which rotates with the bezel 78. The center of the membrane 116 is connected to the top of a shottened lower shaft 90' with the cam member 94 connected thereto. Thus, as the bezel 78 is rotated, the cam member 94 is rotated to operate the infinite position switch as previously described. The actuating arms 106 of the microswitches 104 of FIG. 14 are positioned to ride along the under surface of the membrane 116 as it rotates. By applying finger pressure to the surface of the membrane 16 over an actuating arm 106 as indicated by the arrow 118, the associated microswitch 104 can be closed just as when the pressure member 102 was tipped in the embodiment of FIG. 14.

FIG. 18 shows a similar approach wherein the membrane 116' is non-flexible and is connected to the cam member 94 by legs 120. An X,Y device, generally indicated as 122, such as those employed in the embodiments of FIGS. 11–13 (e.g. trackball, slide switches, or the like) is carried by the membrane 116' within the bezel 78.

Wherefore, having thus described my invention, I claim:

1. A switch which can indicate an infinite number of positions about a rotary axis for use in providing position selection inputs to a computer comprising:

(a) a multi-lobed cam member rotatable about the axis and having a switch position between each adjacent pair of said lobes;

(b) first and second switches disposed for sequential operation by said lobes as said cam member is rotated, the sequence of operation of said switches being a function of the direction said cam member is rotated; and, (c) logic means connected to said switches for determining the direction of rotation of said cam member from the sequence of operation of said switches and for counting positions from a known starting point as said switches are closed and opened by said lobes a presently selected position count being output to the computer whereby the presently selected position as input by the computer is equal to the number of positions said cam member is presently rotated about the axis from said known starting point.

2. The switch of claim 1 wherein:

said first and second switches each have a spring biased actuating arm riding along said lobes and into valleys between said lobes whereby said actuating arms act as detents to cause said cam member to snap from position to position.

3. A switch which can indicate an infinite number of positions about a rotary axis for use in providing position selection inputs to a computer comprising:

(a) a multi-lobed cam member rotatable about the axis and having a switch position between each adjacent pair of said lobes;

(b) first and second switches disposed for sequential operation by said lobes as said cam member is rotated, said first and second switches each having a spring biased actuating arm riding along said lobes and into valleys between said lobes whereby said actuating arms act as detents to cause said cam member to snap from position to position, the sequence of operation of said switches being a function of the direction said cam member is rotated; and, (c) logic means connected to said switches for determining the direction of rotation of said cam member from the sequence of operation of said switches and for counting positions from a known starting point as said switches are closed and opened by said lobes a presently selected position count being output to the computer whereby the presently selected position as input by the computer is equal to the number of position said cam member is presently rotated about the axis from said known starting point.

* * * * *